United States Patent [19]

Hamner

[11] Patent Number: 4,501,653

[45] Date of Patent: Feb. 26, 1985

[54] PRODUCTION OF JET AND DIESEL FUELS

[75] Inventor: Glen P. Hamner, Baton Rouge, La.

[73] Assignee: Exxon Research & Engineering Co., Florham Park, N.J.

[21] Appl. No.: 516,446

[22] Filed: Jul. 22, 1983

[51] Int. Cl.[3] ..... C10G 65/12

[52] U.S. Cl. ..... 208/89; 208/15; 208/59

[58] Field of Search ..... 208/15, 58, 59, 89, 208/57; 585/14

[56] References Cited

U.S. PATENT DOCUMENTS

| | | | |
|---|---|---|---|
| 3,166,489 | 1/1965 | Mason et al. | 208/57 |
| 3,509,040 | 4/1970 | McKinney et al. | 208/59 |
| 3,544,448 | 12/1970 | Jacobs et al. | 208/59 |
| 3,808,122 | 4/1974 | White et al. | 208/59 |
| 3,835,022 | 9/1974 | Frayer et al. | 208/15 |
| 3,891,538 | 6/1975 | Walkey | 208/50 |
| 3,985,638 | 10/1976 | Kirk, Jr. | 208/15 |
| 4,338,186 | 7/1982 | Reif et al. | 208/89 |
| 4,342,641 | 8/1982 | Reif et al. | 208/89 |
| 4,409,092 | 10/1983 | Johnson et al. | 208/89 |

FOREIGN PATENT DOCUMENTS

| | | | |
|---|---|---|---|
| 836104 | 6/1960 | United Kingdom | 208/15 |
| 1234960 | 6/1971 | United Kingdom | 208/15 |

*Primary Examiner*—Delbert E. Gantz
*Assistant Examiner*—O. Chaudhuri
*Attorney, Agent, or Firm*—Lewellyn A. Proctor

[57] ABSTRACT

A process for the production of jet fuels, diesel fuels, multi-purpose fuels meeting the specifications for both high grade jet fuels and diesel fuels, and high quality blending components useful for the production of such fuels; and the compositions produced thereby. In accordance with the process, a multi-reactor system, inclusive of a first reactor and a second reactor are connected through a first distillation column which separates the product of the first reactor into two or more fractions to provide a heavy feed fraction which is charged to the second reactor, wherein the heavy feed is hydroselectively cracked. The product from the second reactor is fractionated to produce high quality jet and diesel fuels, multi-purpose jet and diesel fuels, or provide a major blending component for the production of such fuels, or fuel components.

15 Claims, 1 Drawing Figure

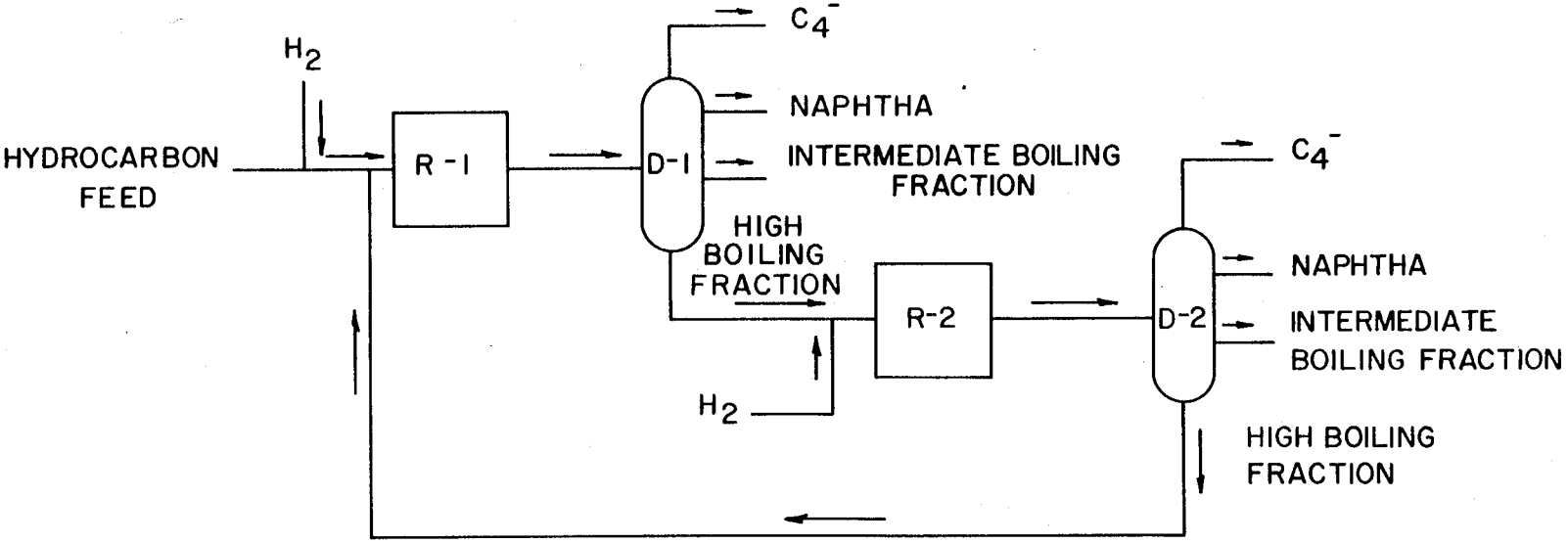
HYDROCARBON FEED
$H_2$
R-1
D-1
$C_4^-$
NAPHTHA
INTERMEDIATE BOILING FRACTION
HIGH BOILING FRACTION
$H_2$
R-2
D-2
$C_4^-$
NAPHTHA
INTERMEDIATE BOILING FRACTION
HIGH BOILING FRACTION

PRODUCTION OF JET AND DIESEL FUELS

BACKGROUND OF THE INVENTION

I. Field of the Invention

This invention relates to a process for the production of jet fuels, diesel fuels, multi-purpose fuels meeting the critical properties required for both high grade jet fuels and diesel fuels, and high quality blending components useful for the production of such fuels.

II. Description of the Prior Art

Various fractions and blends of mid-distillate fuels are required for the operation and functioning of both diesel and jet engines. The diesel engine, a consumer of mid-distillate fuels, is one of the world's most efficient power sources. It converts more of the energy contained in a given quantity of fuel into useful energy than any other power-developing engine. The future of the diesel engine, because of its ability to burn mid-distillate fuels at higher efficiency over the entire range of speed and load is assured. There are strong incentives for the continued development of railroad, marine, and automotive diesel engines for both commercial and military use. Moreover, the development of advanced jet engines for military and commercial aviation use advances rapidly. Consequently, the growth in the demand for mid-distillate fuels is expected to continue.

Early British and American jet engines were developed on a kerosene fuel similar in many respects to JP-5, a 320°-520° F. boiling range fuel having a freeze point of −50° F. The U.S. military version of this fuel was called JP-1, and the specifications for this fuel also required a freeze point of −50° F. Because such narrow-cut kerosene was of limited availability, the U.S. Air Force adopted as its standard a wide cut mixture of gasoline and kerosene capable of being produced in high yield from petroleum crude.

The first wide cut-military fuel, JP-3, had the vapor pressure characteristics of aviation gasoline. This degree of volatility, however, proved excessive in actual use and accordingly the front end boiling range of the fuel was adjusted to a maximum vapor pressure of 3 psi. The result was JP-4, the standard workhorse fuel for most of the world's air forces. JP-4 is a fuel having a 100°-550° F. boiling range, and a freeze point of −76° F. The U.S. Navy, however, requires the use of JP-5 kerosene fuel because high flash products are necessary to insure safety aboard aircraft carriers. AVTUR, a kerosene fuel first used by the Royal Air Force and still in use, became the model for the first commercial jet fuels principally because British Airline launched the jet age, first with the Comet 1 and then with the turboprop Viscounts. An American version of AVTUR followed which was called Jet A. This being followed by a commercial version of JP-4 which was called Jet B, or Kerosene 1B.

Diesel fuels are primarily used by the military as transportation, or automotive fuels. Diesel fuel has a boiling range of about 320°-650° F., and a pour point of 0° F. Typically, diesel fuel is constituted of a 40% admixture of a 320°-550° F. kerosene and 60% light cat cycle oil fractions. A special diesel fuel known as "Artic Diesel," largely used by the military, is constituted of a 200°-520° F. naphtha/kerosene cut having a pour point of −40° F.

Various engine factors are significant for the proper performance of jet and diesel engines, and consequently certain fuel quality standards are necessary for maintaining acceptable engine performance. Certain of these properties are particularly critical. For example, in jet fuels low freeze points are required to maintain fluidity, or flowability of the fuel at low temperatures. Flash points must be relatively high, since volatile materials are more readily ignitable in the event of spills. A consideration of the flash point of a jet fuel is thus invariably an important safety factor in determining the use of a particular jet fuel for a given use. Thus, the reason for the U.S. Navy's insistance on the use of JP-5 aboard carrier aircraft is because of the fire hazard of spills. Thermal stability is also an important consideration because, under certain temperature conditions some fuels can form insoluble deposits or varnish to clog screens and fine nozzle ports which reduces fuel flow to the engine, or impair the heat exchange characteristics of the fuel. The levels of aromatics and olefins in a jet fuel are also limited to certain specifications. Diesel fuels, on the other hand, are governed by criteria which may or may not be closely related to those governing the requirements of jet fuels. For example, with the exception of Artic Diesel, which is used in extremely cold climates, freeze point is not an important consideration in determining the standards of a fuel for use in diesel engines. However, flash point, an index of the fire hazard, is of considerable importance, albeit this property is of far lesser importance for use in an automotive diesel engine as compared with its use in a high performance jet engine. Pour point, or the minimum temperature at which a fuel will remain liquid, and flash point are particularly important considerations in all diesel fuels. Operation below the cloud point, or temperature at which crystals begins to form, will result in the pluggage of the fuel filters by wax.

There are similarities, but also wide differences between the characteristics required for a jet fuel vis-a-vis the characteristics required for a diesel fuel. Moreover, there are considerable differences between the characteristics of one jet fuel and another, and between the characteristics of one diesel fuel and another. Thus, jet fuels must be tailored for a wide variety of engines, and types of aircraft. A consideration of the best jet fuel for a specific use would thus be determined by the type of engine, e.g., whether the engine is a turbo jet, a turboprop, a turbofan, or ramjet engine, and the type of airplane, or service in which the airplane is to be used. A fuel best suited for a Mock 1 aircraft may not be suited for use in a Mock 3 airplane. Military usage may dictate the use of different fuels from those used commercially. Further, as suggested, there are differences between the characteristics of one diesel fuel and another. For example, a diesel fuel used for personal automative transportation purposes in Texas would differ considerably from an artic diesel, or diesel manufactured for use in an artic climate. Also, certain types of diesel engines are more critical of fuel than others. For example, high speed engines (1000-2500 RPM) require a higher quality fuel than medium speed engines (500-1000 RPM), which in turn are more critical of fuel than low speed engines (under 500 RPM). The standardization of materials, or parts, is always a highly desirable objective, particularly among the military. This however, is often an illusory objective, particularly with fuels because of the wide range of requirements dictated by the varying usages of one jet fuel and another, or between one diesel fuel and another, or by the varying usages required of jet fuels and diesel fuels, supra.

There is, in any event, a need for a novel process for the production in good yields of jet fuels and diesel fuels, particularly high quality jet fuels and diesel fuels. There is also a need for a process suitable for the production of standard fuels, or fuels suitable for a wide number of commercial and military needs, notably multi-purpose jet fuels or multi-purpose diesel fuels, or multi-purpose fuels suitable for use in both jet and diesel engines; as well as a need for such fuel compositions.

It is, accordingly, a primary objective of this invention to fill these and other needs.

A specific object of this invention is to provide a process suitable for the production of standard fuels, or fuels suitable for a wide number of commercial and military needs, notably multi-purpose jet fuels or multi-purpose diesel fuels, multi-purpose fuels suitable for use as both a jet fuel and diesel fuel, or high quality blending component for the production of such fuels.

A further, and equally specific object of this invention is to provide multi-purpose jet fuels or multi-purpose diesel fuels, multi-purpose fuels suitable for use as both a jet fuel and diesel fuel, or high quality blending component suitable for the production such fuels.

A further object is to provide multi-purpose fuel compositions, and process for the production of multi-purpose fuel compositions which meet at least the minimum requirements of both jet and diesel fuels as relates to such cold flow properties as freeze point and pour point, flash point, thermal stability, and aromatics and olefins concentrations; as well as imposing limitations on the concentrations of 450° F.+ n-paraffins levels in such compositions.

DESCRIPTION OF THE INVENTION

These objects and others are achieved in accordance with the present invention embodying process, and compositions. The process is one constituted of a multi-reactor unit, or system wherein, in an initial reactor, or reactors, a suitable low sulfur/low nitrogen feed is prepared by hydrodenitrogenation of a light hydrocarbon fraction such as derived from petroleum, or preferably shale oil, and this feed hydroselectivity cracked over a zeolite type cracking catalyst to produce said high quality jet fuel, or diesel fuel, fuel suitable as both a jet fuel and diesel fuel, or high quality blending component for the production of such fuels.

The preferred compositions of this invention produced by such process are multi-purpose fuel compositions which meet certain critical properties required for both jet fuels and diesel fuels, viz., such cold flow properties as freeze point and pour point, flash point, thermal stability, maximum aromatics and olefins concentrations; and, preferably also maximum 450° F.+ n-paraffins concentrations. By lowering the 450° F.+ n-paraffins content of the fuel, very low freeze points can be obtained. Preferably, the compositions of this invention contain less than about 10 wt. % 450° F.+ n-paraffins, more preferably less than about 5 wt. %, and most preferably less than about 2 wt. % 450° F.+ n-paraffins. These fuels are suitable per se for direct use in jet and diesel engines, or such fuels can be further blended with other higher or lower boiling hydrocarbon fractions, or both, for use in such engines.

The more preferred fuel compositions of this invention can be characterized as multi-purpose fuels which meet all of the critical property requirements of (1) JP-4, diesel, and artic diesel fuels and (2) JP-5, diesel, and artic diesel fuels; which latter fuel will also meet the critical property requirements of (3) JP-4, JP-5, diesel and artic diesel fuels. The critical property requirements of fuels produced by the process of this invention are tabulated in Table I (Columns 6 and 7), these being referred to as (1) JP-4/Diesel and (2) JP-5/Diesel, respectively, and these are contrasted, for convenience, with the critical property requirements of JP-4, JP-5, Artic Diesel, and diesel (Columns 2 through 5).

TABLE I

| Critical Properties | JP-4 | JP-5 | Artic Diesel | Diesel | Multi-Purpose Fuels of this Invention JP-4/ Diesel | JP-5/ Diesel |
|---|---|---|---|---|---|---|
| Cold Flow Properties: | | | | | | |
| Freeze Point, °F. | −76 | −50 | −55 | | −76 | −76 |
| Pour Point, °F. | | | −60 | 0 | <−50 | <−50 |
| Flash Point, °F. | | >140 | >100 | >120 | 100 | >140 |
| Thermal Stability(1) | | | | | | |
| Pressure drop KPa | 3.3 | 3.3 | | | 3 | 3 |
| Preheater Deposit, Code No. | 3 | 3 | | | 3 | 3 |
| Aromatics, Wt. % (max.) | 25 | 25 | | | 25 | 25 |
| Olefins, Vol. % (max.) | 5 | 5 | | | 5(3) | 5(3) |
| 450° F.+ n-paraffins Wt. % (max.) | | | | | <10(2) | <10(2) |

(1)CRC Tests (or JFTOT; ASTM-D-3241).
(2)Can meet <5, and <2.
(3)Can meet <1.

In accordance with the process of this invention, hydrocarbon fraction having an initial boiling point ranging from about 100° F. to about 250° F., preferably from about 120° F. to about 160° F., and an end boiling point ranging from about 600° F. to about 750° F., preferably from about 650° F. to about 700° F., is contacted in an initial reactor, or reactors, over a catalyst constituted of a Group VI-B or Group VIII metal, or admixture thereof, dispersed on an inorganic oxide support, suitably alumina, at conditions which hydrodesulfurize and hydrodenitrogenate the feed to produce a product having less than about 100 parts, per million parts by weight (ppm) of sulfur, preferably less than about 10 ppm of sulfur, and less than about 50 ppm of nitrogen, preferably less than about 5 ppm of nitrogen. Suitably, such reaction is conducted at temperatures ranging from about 600° F. to about 800° F., preferably from about 650° F. to about 750° F., pressures ranging from about 500 pounds per square inch (psi) to about 2500 psi, preferably from about 800 psi to about 2000 psi, space velocities ranging from about 0.2 V/Hr/V to about 5 V/Hr/V, preferably from about 0.5 V/Hr/V to about 2 V/Hr/V, and hydrogen rages ranging from about 1000 SCF/B to about 10,000 SCF/B, preferably from about 2000 SCF/B to about 6000 SCF/B. Such product is readily separated into $C_4$− gases and liquid naphtha, as well as (1) an intermediate boiling liquid fraction having an initial boiling point ranging from about 290° F. to about 340° F., preferably about 310° F. to about 320° F., and an end boiling point ranging from about 420° F. to about 470° F., preferably about 450° F. to about 460° F., which is suitable per se as a high grade jet fuel, or high grade jet fuel blending component, and (2) a high boiling liquid feed component suitable for hydroselectively cracking in a subsequent reactor, or reactors, in the presence of a zeolite cracking catalyst to produce high grade jet fuel, diesel fuel, multi-purpose fuel suitable for use as a jet fuel or diesel fuel, or major blending component for use in the production of such fuels.

The high boiling liquid feed component (2), supra, is used as feed to the hydroselective cracking reactor, or reactor containing the zeolite cracking catalyst. The initial boiling point of this feed is set by the end boiling point of the high boiling feed component (2), supra; i.e., between about 420° F. and about 470° F., preferably between about 450° F. and 460° F., The initial boiling point of this feed is thus one having an initial boiling point of about 420° F., or greater, preferably about 450° F., or greater, suitably, e.g., about 450° F.+, and the reactor is operated at conditions sufficient to crack out and eliminate normal paraffins which are converted primarily to lower boiling liquid products and gas. The zeolite cracking catalyst over which the high boiling liquid component is passed is constituted of a crystalline alumino silicate zeolite base, or admixture of inorganic oxides containing such base, e.g., a zeolite with an alumina binder, on which is dispersed a metal hydrogenation component. Preferred zeolites are those having pore sizes ranging up to about 6 Å. Suitable small pore zeolite cracking bases are erionite, silicalite 5 Å, offeritite, chabazite, and ZSM-5 type zeolites such as ZSM-5, ZSM-11, ZSM-12, ZSM-35, ZSM-38, and the like. Suitable hydrogenation components are the Group VI-B, Group VIII, or admixture of the Group VI-B and Group VIII metals of the Periodic Table of the Elements (E. H. Sargent & Co., Copyright 1962 Dyna Slide Co.), e.g., molybdenum, tungsten, nickel, cobalt, platinum, palladium, nickel-molybdenum, nickel-tungsten and the like. The hydroselective cracking reaction is carried out generally at temperature ranging from about 450° F. to about 800° F., preferably from about 550° F. to about 750° F., pressures ranging from about 250 psi to about 2000 psi, preferably from about 500 psi to about 1500 psi, space velocities ranging from about 0.2 V/Hr/V to about 5 V/Hr/V, preferably from about 0.5 to about 2 V/Hr/V, and at hydrogen rates of from about 500 SCF/B to about 5000 SCF/B, preferably about 1000 SCF/B to about 2000 SCF/B.

The product from the hydroselective cracking reactor, which includes $C_4$− gases, is readily separable into a naphtha fraction and a high quality fuel fraction or intermediate boiling liquid fraction suitable for use as a high grade jet fuel, diesel fuel, multi-purpose fuel suitable for use as a jet fuel or diesel fuel, or major blending component for use in the production of such fuels. The naphtha high end boiling point defines the initial boiling point of the intermediate boiling liquid fraction, or high quality fuel fraction. The initial boiling point of the high quality fuel fraction ranges from about 290° F. to about 340° F., preferably from about 310° F. to about 320° F., and the high end, or final boiling point of the fuel fraction ranges from about 600° F. to about 700° F., preferably from about 620° F. to about 650° F. Higher boiling hydrocarbons are recycled to extinction within the process.

These features and others will be better understood by reference to the following more detailed description of the invention, and to the drawing to which reference is made.

In the drawing:

The FIGURE depicts, by means of a simplified flow diagram, a preferred operation for obtaining a multipurpose fuel meeting the critical property requirements of a JP-5 jet fuel, or a high quality diesel fuel, or both. Blends taken from different side streams, as will be explained by reference to this FIGURE, can also be used to provide a fuel meeting the critical property requirements of a JP-4 jet fuel, or a good quality diesel fuel, or both.

Referring to the FIGURE, generally, there is depicted a two reactor system, a first reactor R-1 and a second reactor R-2 connected through a first distillation column D-1 which separates the product of reactor R-1 into two or more fractions to provide a heavy feed fraction which is charged to reactor R-2, wherein the heavy feed is hydroselectively cracked. Suitably, and preferably, the product from reactor R-2 is fractionated in a second distillation column D-2 to produce, or provide the major blending component for, high quality jet and diesel fuels.

Referring now to the R-1 reactor, a 100°–650° F. hydrocarbon fraction derived from petroleum or shale oil is introduced as a feed, with hydrogen, into reactor R-1 and passed over a Group VI-B/VIII/alumina catalyst, e.g., a $NiMo/Al_2O_3$ catalyst, at temperature ranging from 600°–750° F., pressure ranging from 800–2000 psi, feed rate of about 0.5 to 2 V/Hr/V, and a hydrogen recycle rate of about 2000 to 6000 SCF/B to produce a hydrodesulfurization/hydrodenitrogenation reaction. The sulfur and nitrogen in the product of such reaction is less than about 10 ppm and 5 ppm, respectively.

The hydrodesulfurized, hydrodenitrogenated product of reactor R-1 is introduced into distillation column D-1 and cut into several fractions, viz., $C_4$− gas, $C_5$-320° F. naphtha, a 320°–460° F. mid-distillate fraction, and a 460° F.+ R-2 feed fraction, or 460° F. bottoms fraction which is passed to reactor R-2.

The 460° F.+ $R_2$ feed fraction is passed, with hydrogen, to the R-2 reactor and contacted over a Group VI-B/VIII metal/zeolite catalyst, e.g., a Ni/Mo/(5 Å crystalline zeolite+$Al_2O_3$) catalyst, at conditions which hydroselectively crack the n-paraffins. The R-2 reactor is operated at a temperature of 550° F. to 750° F., pressure ranging from 500 to 1500 psi, a space velocity of 0.5 to 2 V/V/Hr, and hydrogen rate of 1000 to 2000 SCF/B. The $R_2$ reactor product, from which most of the n-paraffins have been effectively removed by conversion to light liquid and gaseous products, is then sent to the second distillation column D-2. In distillation column D-2, the R-2 product is split into $C_4$−, naphtha, an intermediate boiling or 320° F. to 620° F. fraction, and a 620° F.+ bottom liquid fraction which is recycled to extinction in the R-1 reactor. The intermediate boiling or 320° F. to 620° F. liquid fraction, even after blending the production ratio by volume of the 320° F.–460° F. from distillation column D-1, meets the critical property requirements (Table I) for a JP-5 jet fuel, artic diesel fuel, and diesel fuel. It also meets the critical property requirements of a JP-4 jet fuel.

The following are exemplary of the invention. All parts, and percentages, are in terms of weight, unless otherwise specified.

EXAMPLES

A fuel meeting the critical freeze point of both a JP-5 jet fuel, artic diesel fuel, and diesel fuel was prepared by feeding a 28.6 API, 400°–650° F. shale oil fraction, with hydrogen, to a first reactor, R-1, which was charged with a $Ni/Mo/Al_2O_3$ catalyst. The reaction was carried out at 750° F., 1500 psi, 0.5 V/Hr/V and 4000 SCF/B of hydrogen. The stabilized product of the reactor, R-1, or product from which $H_2S$, $NH_3$, and water had been removed, and which contained >2 ppm S and >2 ppm N, was fractionated in a distillation column, D-1, to produce $C_4$− (2.3%), naphtha (7.2%), a low freeze point 320°-470° F. fraction (38.0%) and a 470° F.+ fraction (52.5%).

The 470° F.+ fraction (>0° F. freeze point) was fed, with hydrogen, to a second reactor, R-2, and reacted over a Ni/Mo/(ZSM-5+$Al_2O_3$) catalyst at 585° F., 800 psi, 0.85 V/Hr/V, and 4000 SCF/B of hydrogen. The stabilized product, which was found to have a <−90° F. freeze point, was split in a second distillation column, D-2, into $C_4$− (31.1%), naphtha (10.9%), and 320° F.-620° F. fraction (51.9%), and a 620° F.+ fraction (6.1%) which was recycled to the first reactor, R-1.

The 320° F.-620° F. fraction from D-2, which was found to have a freeze point of <−94° F., was combined with the 320°-470° F. fraction from D-1, the fractions being admixed in production ratio, or weight ratio of 1.4 parts of the 320° F.-470° F. fraction for each part of the 320° F.-620° F. fraction, by weight.

The inspections on this fuel (Column 2), and the critical fuel requirements for JP-5 (Column 3) and Artic Diesel (Column 4) are given in Table II below for comparative purposes.

TABLE II

| Inspections | Blend of 320° F.-470° F. R-1/ 320° F.-620° F. R-2 Fractions | JP-5 Min. | JP-5 Max. | Artic Diesel Min. | Artic Diesel Max. |
|---|---|---|---|---|---|
| Gravity, °API | 37.8 | 36 | 48 | 40 | |
| Sulfur, ppm | | | | | |
| Mercaptan | 0 | | 10 | | |
| Total | 6.4 | | 4000 | | 2500 |
| Nitrogen, ppm | 1.0 | | — | | |
| Cu Strip Corrosion (2 Hr. @ 100° C.) | 1A | | 1B | | 3 |
| Flash, °F. | 145 | 140 | | 100 | |
| Cetane | | | | 40 | |
| Smoke Point, °F. | 18.5 | 19 | | | |
| Freeze Point, °F. | <−76 | | −50 | | −55 |
| Cloud Point, °F. | | | | | −60 |
| Viscosity, K.V. | | | | | |
| @ 100° F. | 2.08 | | 7.5 | 1.4 | 2.2 |
| @ −30° F. | 15.0 | | | | |
| Composition, Wt. % | | | | | |
| Paraffins | 32.7 | | | | |
| Naphthenes | 43.2 | | | | |
| Aromatics | 24.1 | | 25 | | |
| Olefins | Nil | | 5.0 | | |
| Distillate, °F. | | | | | |
| IBP | 290 | | | | |
| 5 | 323 | | | | |
| 10 | 341 | | 402 | | 347 |
| 20 | 368 | | | | |
| 30 | 393 | | | | |
| 40 | 417 | | | | |
| 50 | 441 | | | | |
| 60 | 464 | | | | |
| 70 | 490 | | | | |
| 80 | 521 | | | | |
| 90 | 562 | | | | 550 |
| 95 | 590 | | | | |
| FBP | 620 | | 550 | | 592 |
| Residue, ml | 1.0 | | 1.5 | | — |

A fuel meeting the critical property requirements for JP-4 and an Artic Diesel can also be obtained by blending a portion of the 320° F.-460° F., or intermediate boiling fraction obtained from distillation column D-2, 320° F.-620° F. fraction from distillation column D-2, and naphtha from D-1 or D-2, or both. Thus, production ratios amounting to 32.2 percent by weight of the 320° F.-460° F. fraction from distillation column D-1, 39.5 percent by weight of the 320° F.-620° F. fraction from D-2, 10.4 percent by weight of the naphtha from distillation Column D-1, and 6.9 percent by weight of the naphtha from distillation column D-2 were blended together. The inspections for this fuel blend (Column 2) is given in Table III, along with the critical property requirements for JP-4. (For the critical property requirements on Artic Diesel, reference is made to Table II.)

TABLE III

| Inspections | Blend of Naphtha and 320° F.-470° F. R-1/ 320° F.-620° F. R-2 Fractions[1] | JP-4 Min. | JP-4 Max. |
|---|---|---|---|
| Gravity, °API | 41.7 | 45 | 57 |
| Sulfur, ppm | | | |
| Mercaptan | 0 | | 10 |
| Total | 3.8 | | 4000 |
| Nitrogen, ppm | 0.5 | | — |
| Cu Strip Corrosion (2 Hr. @ 100° C.) | 1A | | 1 |
| Flash, °F. | <100 | | — |
| Smoke Point, °F. | 20 | 20 | |
| Luminometer No. | 41.5 | | |
| Freeze Point, °F. | <−76 | | −74 |
| Viscosity, K.V. | | | |
| @ 100° F. | 1.47 | | |
| @ −30° F. | 9.8 | | |
| Composition, Wt. % | | | |
| Paraffins | 36.7 | | |
| Naphthenes | 40.8 | | |
| Aromatics | 22.6 | | 25 |
| Olefins | Nil | | 5 |
| Distillate, °F. | | | |
| IBP | 253 | | |
| 5 | 291 | | |
| 10 | 307 | | |
| 20 | 333 | | 290 |
| 30 | 358 | | |
| 40 | 386 | | |
| 50 | 414 | | 368 |
| 60 | 442 | | |
| 70 | 472 | | |
| 80 | 506 | | |
| 90 | 551 | | 470 |
| 95 | 582 | | |
| FBP | 613 | | |
| Residue, ml | 1.5 | | 1.5 |

[1]An additional 15% naphtha can be added to this blended product to give an even higher quality fuel.

It is apparent that various modifications and changes can be made in the process, and compositions without departing the spirit and scope of the invention.

Having described the invention, what is claimed is:

1. A process for the production in a multi-reactor unit of jet fuels, diesel fuels, multi-purpose fuels meeting the critical property requirements of jet fuels and diesel fuels, and high quality blending components useful for the production of such fuels, which comprises feeding, with hydrogen, into the initial reactor of the multi-reactor unit, a sulfur and nitrogen-containing hydrocarbon feed having an initial boiling point ranging from about 100° F. to about 250° F., and a high end point boiling within the range of from about 600° F. to about 750° F., passing said feed over a catalyst having a Group VI-B or Group VIII-B metal, or admixture of such metals, dispersed upon an inorganic oxide support at conditions sufficient to hydrodesulfurize and hydrodenitrogenate said feed, distilling said hydrodesulfurized, hydrodenitrogenated fraction to obtain $C_4-$, naphtha, a high boiling liquid fraction having an initial boiling point of from about 420° F. to about 470° F., and a fraction of boiling range intermediate that of said naphtha and said high boiling liquid fraction.

feeding said high boiling product liquid fraction, with hydrogen, into a second reactor of the multi-reactor unit and hydroselectively cracking said fraction over a cracking catalyst constituted of a Group VI-B or Group VIII metal, or admixture thereof, dispersed on a zeolite support of pore size ranging up to about 6 Å at conditions sufficient to eliminate normal paraffins and convert said normal paraffins to lighter boiling liquid and gaseous products, and distilling the product of said second reactor in a fractionating column to obtain $C_4-$, naphtha, a high boiling liquid fraction having an initial boiling point ranging from about 600° F. to about 700° F. which is recycled to extinction in said initial reactor, and a liquid fraction having an initial boiling point between the high end boiling point of said naphtha and the initial boiling point of said recycled high boiling liquid fraction which meets the critical property requirements of a jet fuel, diesel fuel, multi-purpose fuel meeting the specifications for both a jet fuel and diesel fuel, or high quality blending component useful for the production of such fuels.

2. The process of claim 1 wherein the sulfur and nitrogen-containing hydrocarbon feed fed into the initial reactor has an initial boiling point ranging from about 120° F. and about 160° F., and a final boiling point ranging from about 650° F. to about 700° F.

3. The process of claim 2 wherein the sulfur and nitrogen-containing hydrocarbon feed fed into the initial reactor is a shale oil.

4. The process of claim 3 wherein the shale oil boils between about 100° F. and about 650° F.

5. The process of claim 1 wherein the sulfur and nitrogen-containing hydrocarbon feed fed into the initial reactor has an initial boiling point ranging from about 120° F. and about 160° F. and a final boiling point ranging from about 650° F. to about 700° F., and the feed is processed over a catalyst constituted of a Group VI-B metal, Group VIII metal, or admixture of Group VI-B and Group VIII metals dispersed on alumina.

6. The process of claim 5 wherein the catalyst is nickel-molybdenum on alumina.

7. The process of claim 1 wherein the product from the first reactor contains a maximum of about 100 ppm sulfur, and a maximum of about 50 ppm nitrogen.

8. The process of claim 7 wherein the product contains a maximum of about 10 ppm sulfur, and about 5 ppm nitrogen.

9. The process of claim 1 wherein the fraction of boiling range intermediate that of said naphtha and said high boiling liquid fraction used as feed to the second reactor has an initial boiling point ranging from about 290° F. to about 340° F. and a final boiling point ranging from about 420° F. to about 470° F.

10. The process of claim 9 wherein the fraction of boiling range intermediate that of said naphtha and said high boiling fraction used as feed to the second reactor has an initial boiling point ranging from about 310° F. to about 320° F. and a final boiling point ranging from about 450° F. to about 460° F.

11. The process of claim 1 wherein the high boiling liquid fraction fed into the second reactor has an initial boiling point ranging from about 450° F. to about 460° F., the second reactor is operated at a temperature ranging from about 450° F. to about 800° F., pressure ranging from about 250 psi to about 2000 psi, space velocity ranging from about 0.2 to about 5 V/Hr/V, and a hydrogen rate of from about 500 SCF/B to about 5000 SCF/B.

12. The process of claim 11 wherein the high boiling liquid fraction fed into the second reactor has an initial boiling point ranging from about 450° F. to about 460° F., the second reactor is operated at a temperature ranging from about 550° F. to about 750° F., pressure ranging from about 500 psi to about 1500 psi, space velocity ranging from about 0.5 V/Hr/V to about 2 V/Hr/V, and a hydrogen rate of from about 1000 SCF/B to about 2000 SCF/B.

13. The process of claim 1 wherein the initial boiling point of the intermediate boiling fraction from the product of the second reactor having an initial boiling point between the high end boiling point of the naphtha and the initial boiling point of the recycled high boiling liquid fraction ranges from about 290° F. to about 340° F. and the final boiling point of said fraction ranges from about 600° F. to about 700° F.

14. The process of claim 13 wherein the initial boiling point of the intermediate boiling fraction from the product of the second reactor having an initial boiling point between the high end boiling point of the naphtha and the initial boiling point of the recycled high boiling liquid fraction ranges from about 310° F. to about 320° F. and the final boiling point of said fraction ranges from about 620° F. to about 650° F.

15. The process of claim 13 wherein the intermediate boiling range fraction is blended with the distilled fraction from the first reactor which has a boiling range intermediate that of the naphtha and high boiling liquid fractions.

* * * * *